US006258181B1

(12) United States Patent
Yamamoto et al.

(10) Patent No.: US 6,258,181 B1
(45) Date of Patent: Jul. 10, 2001

(54) STRUCTURAL STEEL EXCELLENT IN WEAR RESISTANCE AND FATIGUE RESISTANCE PROPERTY AND METHOD OF PRODUCING THE SAME

(75) Inventors: Kouichi Yamamoto; Hironori Satoh, both of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/509,929

(22) PCT Filed: Aug. 5, 1999

(86) PCT No.: PCT/JP99/04239

§ 371 Date: Apr. 3, 2000

§ 102(e) Date: Apr. 3, 2000

(87) PCT Pub. No.: WO00/08221

PCT Pub. Date: Feb. 17, 2000

(30) Foreign Application Priority Data

Aug. 5, 1998 (JP) ..... 10-232385
Aug. 5, 1998 (JP) ..... 10-232386

(51) Int. Cl.[7] ..... C22C 38/42; C22C 38/44; C22C 38/08

(52) U.S. Cl. ..... 148/336; 148/335; 148/332

(58) Field of Search ..... 148/648, 336, 148/335, 332

(56) References Cited

FOREIGN PATENT DOCUMENTS

| | | |
|---|---|---|
| 4-333516 | 11/1992 | (JP) . |
| 5-311324 | 11/1993 | (JP) . |
| 6-10043 | 1/1994 | (JP) . |
| 8-134587 | 5/1996 | (JP) . |
| 9-95754 | 4/1997 | (JP) . |
| 9-165647 | 6/1997 | (JP) . |
| 9-249915 | 9/1997 | (JP) . |
| 10-96027 | 4/1998 | (JP) . |

*Primary Examiner*—Deborah Yee
(74) *Attorney, Agent, or Firm*—Kenyon & Kenyon

(57) ABSTRACT

A structural steel excellent in wear resistance and fatigue resistance property, for use as a structural member of a bridge, pylon or the like erected in a shore region where there is concern about steel corrosion and fatigue at weld joint owing to scattering of sea salt particles or in a region where snow-melting salt is used, is provided at low cost and by a simple production method. The hot rolled structural steel contains, in percentage by weight, C: 0.02–0.20%, and further added with small amounts of Ni, Cu and Mo as essential elements, that is a rolled steel excellent in wear resistance and fatigue resistance property having a Ni/Cu concentration ratio of not less than 0.8, a steel surface internal oxide layer of not greater than 2 μm, and a Ni, Cu and Mo concentrated layer of a thickness of not less than 2 μm on the internal oxide layer.

24 Claims, 7 Drawing Sheets

INTERNAL OXIDE LAYER

MATRIX

INTERNAL OXIDE LAYER

MATRIX

STRUCTURAL STEEL EXCELLENT IN WEAR RESISTANCE AND FATIGUE RESISTANCE PROPERTY AND METHOD OF PRODUCING THE SAME

TECHNICAL FIELD

The present invention relates to a structural steel excellent in wear resistance and fatigue resistance property for use as a structural member of a bridge, pylon or the like erected in a shore region where there is concern about corrosion of steel and metallic fatigue at weld joint owing to scattering of sea salt particles or in a region where snow-melting salt is used, and a method of producing the same.

BACKGROUND TECHNOLOGY

The service life of a bridge, pylon or the like is determined by the corrosion and fatigue of its steel. Extremely long service life is possible depending on corrosion resistance and fatigue resistance. Even in the case of current wear resistant steels, however, prevention of corrosion without a coating is difficult in regions near the seashore where salinity is high and regions where snow-melting salt is used. Painting, plating or other anti-corrosion treatment must be carried out regularly. In addition, joints, such as weld joints, experience metallic fatigue over long periods owing to the vibration produced by vehicles. The problem of having to carry out regular, large-scale repair work therefore arises.

FIG. 1 shows the results of atmosphere-exposure tests conducted on carbon steel and wear resistant steel in Japan. The data represent the results of atmosphere-exposure tests particularly at coastal industrial zones were corrosion is particularly great. Over a long test period of 10 years during which the $SO_x$ concentration increased, the amount of thickness loss, an index of amount of corrosion, reached 0.5 mm per side in the case of carbon steel. On the other hand, wear resistant steel turned in excellent results of under 0.2 mm. The need for this type of steel is therefore increasing more and more, and calls for further improvements have been heard.

Various solutions for these problems have been proposed. As typical examples, Japanese Unexamined Patent Publications No. 8(1996)-134587 and No. 9(1997)-165647 teach welded structural steels excellent in wear resistance that contain not greater than 0.15% of C and are further added with strengthening elements such as Mn, Ni and Mo to adjust to Ni+3Mo≧1.2%, or Ni+Cu+3Mo≧1.2%, Ceq: 0.5 or less. Japanese Unexamined Patent Publication No. 8(1986)-277439, teaches a steel composed of lath-like ferrite and cementite whose weld heat affected regions have high fatigue strength owing to a metallic texture containing as-transformed martensite at an area ratio of not less than 0.5% and not greater than 5%. Japanese Unexamined Patent Publication No. 9(1997)-249915 teaches elevation of the fatigue limit by adding appropriate amounts of Mn, Ti and B to make the texture bainite single phase without depending on cooling rate, while also achieving structural strengthening, utilizing precipitation of Cu and solid solution strengthening to enhance tensile strength and improve fatigue resistance, and also conducting rolling at a reduction ratio of not less than 30% in the unrecrystalized low-temperature zone or in the temperature range of the dual-phase region.

However, none of these conventional technologies enables endurance, without coating, against use in regions near the seashore where salinity is high and regions where snow-melting salt is used. As in the past, joints, such as weld joints, experience metallic fatigue over long periods owing to the vibration produced by vehicles, so that regular, large-scale repair work is necessary.

DISCLOSURE OF THE INVENTION

This invention was accomplished to overcome the foregoing problems. In a steel for use as a structural steel used in a bridge, a pylon or the like erected in a shore region where there is concern about corrosion resistance and fatigue resistance at weld joint owing to scattering of sea salt particles or in a region where snow-melting salt is used, its object is to provide a hot rolled structural steel excellent in wear resistance and fatigue resistance property, and a method of producing the same.

In the aforesaid steel for use as a structural steel of a bridge, pylon or the like erected in a shore region where there is concern about corrosion of steel and metallic fatigue at weld joint owing to scattering of sea salt particles or in a region where snow-melting salt is used, the present invention successfully provides a hot rolled structural steel excellent in wear resistance and fatigue resistance property by, in order to suppress generation of internal oxides that act as a source of corrosion starting points and, depending on the steel type, prevent grain boundary oxidation by addition of Cr, additionally adjusts Ni/Cu concentration ratio, adds Ni, Cu and Mo, and controls thickness of a steel surface internal oxide layer, thickness of a Ni, Cu and Mo concentrated layer formed on the internal oxide layer, and total amount of element concentration of these layers. Specifically, the present invention focuses on 1) reducing amount of Si, Mn and Cr addition to suppress generation of internal oxides, i.e., reducing internal oxides that become corrosion and/or fatigue starting points, 2) adding Ni, Cu and Mo to form an alloy-concentrated layer and suppress corrosion and/or fatigue, and 3) adding Cr and reducing Si to suppress grain boundary oxidation, reduce stress concentration portions, reduce corrosion starting points and suppress internal oxide layer enlargement. Its gist is as follows.

(1) A structural steel excellent in wear resistance and fatigue resistance property containing, in percentage by weight, C: 0.02~0.20%, and further added with small amounts of Ni, Cu and Mo as essential elements, characterized in having a Ni/Cu concentration ratio of not less than 0.8, a steel surface internal oxide layer of not greater than 2 μm, and a Ni, Cu and Mo concentrated layer of a thickness of not less than 2 μm on the internal oxide layer.

(2) A structural steel excellent in wear resistance and fatigue resistance property containing, in percentage by weight, C: 0.02~0.20% and Cr: 0.1~0.5%, and further added with small amounts of Ni, Cu and Mo as essential elements, characterized in having a Ni/Cu concentration ratio of not less than 0.8, a steel surface internal oxide layer of not greater than 2 μm, and a Ni, Cu and Mo concentrated layer of a thickness of not less than 2 μm on the internal oxide layer.

(3) A structural steel excellent in wear resistance and fatigue resistance property characterized in comprising, in percentage by weight,

C: 0.02~0.20%,

Mn: ≦0.1%,

Si: ≦0.1%,

Cr: ≦0.1%,

Al: ≦0.1%,

Ti: ≦0.1%,

Ni: 0.8~3.0%,

Cu: 0.8~2.0%,

Mo: 0.4~0.7%,

N: 0.001~0.01%,

P: ≦0.1%, and

S: ≦0.006%, the Ni/Cu concentration ratio being not less than 0.8 and the balance being Fe and unavoidable impurities, and having a steel surface internal oxide layer of not greater than 2 μm, and a Ni, Cu and Mo concentrated layer of a thickness of not less than 2 μm on the internal oxide layer, the total amount of element concentration of Ni, Cu and Mo being not less than 7.0 wt %.

(4) A structural steel excellent in wear resistance and fatigue resistance property characterized in comprising, in percentage by weight,

C: 0.02~0.20%,

Mn: 0.4~2.0%,

Si: ≦0.1%,

Cr: 0.1~0.5%,

Al: 0.001~0.10%,

Ti: ≦0.1%,

Ni: 0.3~3.0%,

Cu: 0.3~1.5%,

Mo: 0.1~0.7%,

N: 0.001~0.010%,

P: ≦0.1%, and

S: ≦0.006%, the Ni/Cu concentration ratio being not less than 0.8 and the balance being Fe and unavoidable impurities, and having a Ni, Cu and Mo concentrated layer of a thickness of not less than 2 μm on a steel surface internal oxide layer, the total amount of element concentration of Ni, Cu and Mo being not less than 4.0 wt %.

(5) A structural steel excellent in wear resistance and fatigue resistance property set out in any of (1)~(4) above, characterized in further comprising, in percentage by weight, at least one of Nb: 0.005~0.10%, V: 0.01~0.20% and B: 0.0003~0.0030%.

(6) A structural steel excellent in wear resistance and fatigue resistance property set out in any of (1)~(4) above, characterized in further comprising, in percentage by weight, at least one of Ca: 0.0005~0.0050%, Mg: 0.0005~0.010% and REM: 0.0005~0.010%.

(7) A structural steel excellent in wear resistance and fatigue resistance property set out in any of (1)~(4) above, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

(8) A method of producing a structural steel excellent in wear resistance and fatigue resistance property characterized in starting hot rolling of a slab after reheating to a temperature range of 1100~1300° C., conducting hot rolling at not higher than 950° C. to obtain a cumulative reduction of not less than 40%, and completing hot rolling at not lower than 900° C., thereby obtaining as-hot-rolled a steel having a surface internal oxide layer of not greater than 2 μm, and a Ni, Cu and Mo concentrated layer of a thickness of not less than 2 μm on the internal oxide layer, total amount of element concentration of Ni, Cu and Mo being not less than 7.0 wt %, the slab comprising, in percentage by weight,

C: 0.02~0.20%,

Mn: ≦0.1%,

Si: ≦0.1%,

Cr: ≦0.1%,

Al: ≦0.1%,

Ti: ≦0.1%,

Ni: 0.8~3.0%,

Cu: 0.8~2.0%,

Mo: 0.4~0.7%,

N: 0.001~0.01%,

P: ≦0.1%, and

S: ≦0.006%,

Ni/Cu concentration ratio being not less than 0.8 and the balance being Fe and unavoidable impurities.

(9) A method of producing a structural steel excellent in wear resistance and fatigue resistance property characterized in starting hot rolling of a slab after reheating to a temperature range of 1100~1300° C., and conducting hot rolling at not higher than 950° C. to obtain a cumulative reduction of not less than 40%, thereby obtaining a Ni, Cu and Mo concentrated layer of a thickness of not less than 2 μm on a steel surface internal oxide layer, total amount of element concentration of Ni, Cu and Mo being not less than 4.0 wt %, the slab comprising, in percentage by weight,

C: 0.02~0.20%,

Mn: 0.4~2.0%,

Si: ≦0.1%,

Cr: 0.1~0.5%,

Al: 0.001~0.10%,

Ti: ≦0.1%,

Ni: 0.3~3.0%,

Cu: 0.3~1.5%,

Mo: 0.1~0.7%,

N: 0.001~0.010%,

P: ≦0.1%, and

S: ≦0.006%, the Ni/Cu concentration ratio being not less than 0.8 and the balance being Fe and unavoidable impurities.

(10) A method of producing a structural steel excellent in wear resistance and fatigue resistance property set out in (8) or (9) above, characterized in further comprising, in percentage by weight, at least one of Nb: 0.005~0.10%, V: 0.01~0.20% and B: 0.0003~0.0030%.

(11) A method of producing a structural steel excellent in wear resistance and fatigue resistance property set out in (8) or (9) above, characterized in further comprising, in percentage by weight, at least one of Ca: 0.0005~0.0050%, Mg: 0.0005~0.010% and REM: 0.0005~0.010%.

(12) A method of producing a structural steel excellent in wear resistance and fatigue resistance property set out in (8) or (9) above, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

BRIEF DESCRIPTION OF THE DRAWINGS

FIG. 2(*b*) shows the formed state of an internal oxide layer according to the present invention.

FIG. 5(*b*) is a sectional view of the texture of steel added with 0.20% of Cr according to the present invention.

BEST MODES FOR CARRYING OUT THE INVENTION

The inventors made an intensive study of the grain boundary oxidation mechanism of 400~700 MPa-class H-shape steels. As a result, they learned that the internal oxide layer and the Ni, Cu, Mo and other trace elements added as strengthening elements have a pronounced effect. Specifically, they learned that the internal oxide layer formed at the matrix surface layer portion is formed as a dealloyed layer including mixed grains of independent and composite oxides, namely, of Fe and MnO, SiO and the like, that these elements combine with oxygen in the air to form fayalite ($2SiO_2FeO$), that this becomes a source of corrosion starting points and leads to grain boundary oxidation, and that MnS produced owing to the presence of Mn becomes a source of starting points for pitting that markedly degrade wear resistance.

Figure 1:
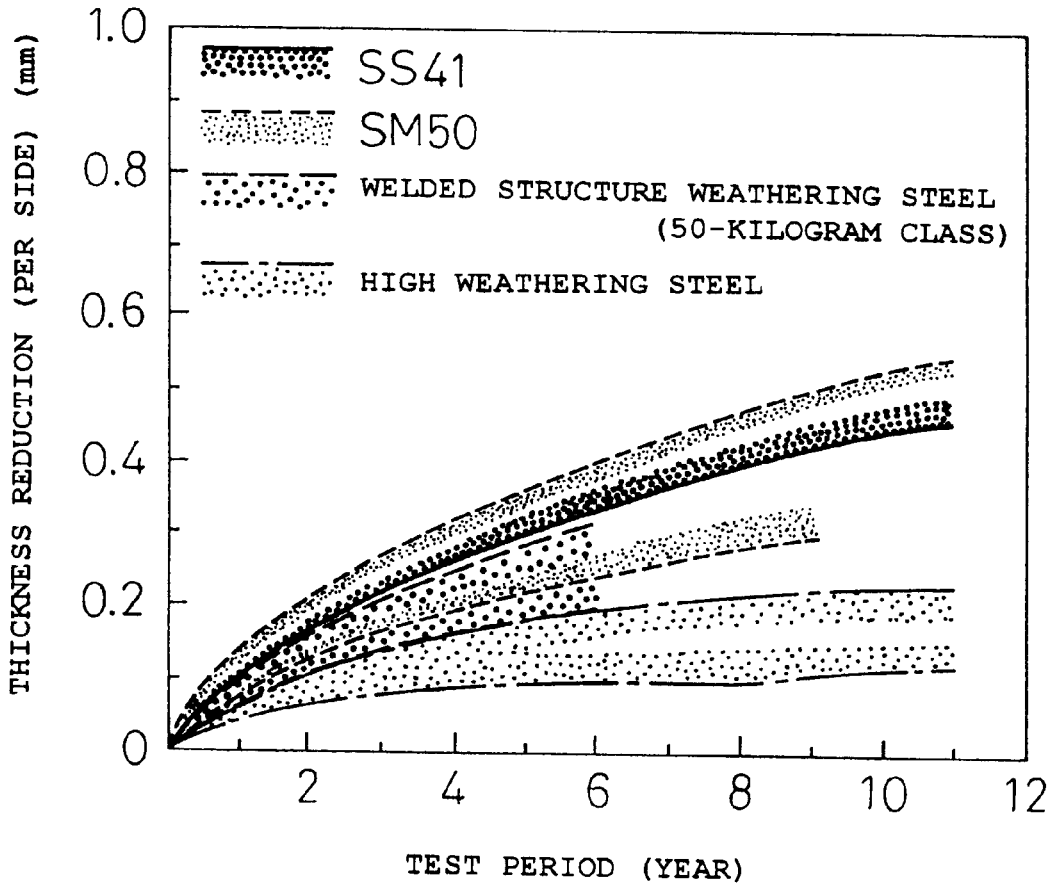
FIG. 1 is graph showing the results of atmosphere-exposure tests conducted on carbon steel and wear resistance steel in Japan.
Figure 2A:
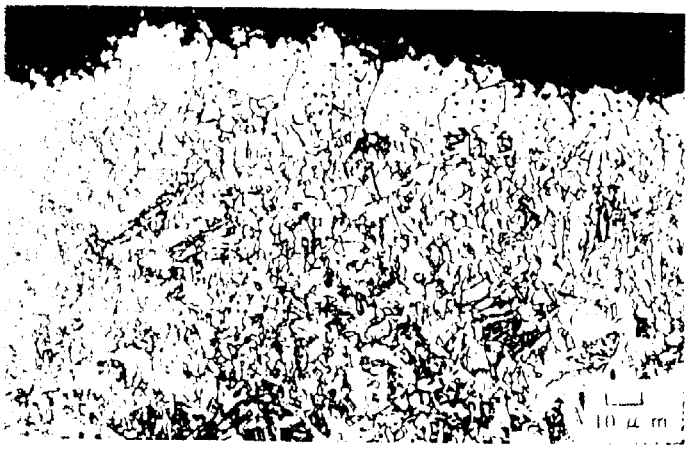
FIG. 2(*a*) shows the formed state of an internal oxide layer in a conventional shape steel.
Figure 2B:
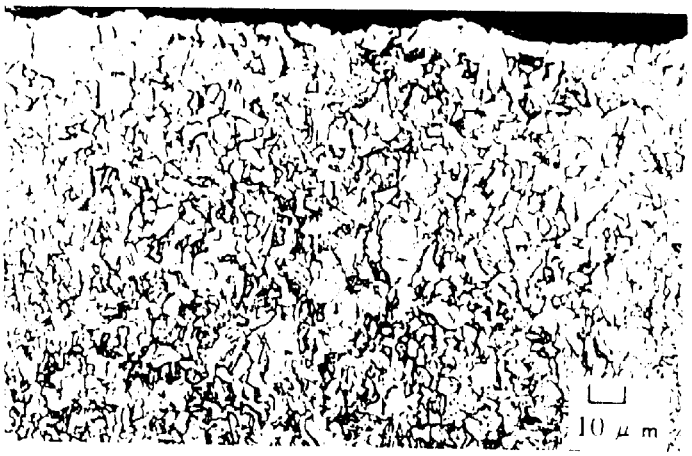

They therefore studied various factors for improving wear resistance. The formation of the aforesaid internal oxide layer acting as a source of corrosion starting points can be markedly suppressed by reducing the amount of each of Si, Mn and Cr, which oxidize more readily than iron (FeO). FIG. 2(*a*) shows the formed state of the internal oxide layer in the case where the Si, Mn and Cr amounts (Si: 0.35%, Mn: 1.3% and Cr: 0.3%) contained in an ordinary high-tensile H-shape steel are not reduced. FIG. 2(*b*) shows the formed state of the internal oxide layer in the case where the Si, Mn and Cr amounts (Si: 0.05%, Mn: 0.04% and Cr: 0.01%) are reduced according to the present invention. As is clear from FIG. 2(*b*), in the present invention steel reduced in amounts of Si, Mn and Cr, the internal oxide layer has an extremely thin thickness of less than 2 $\mu$m. Further, in the present invention, as explained earlier, the amount of Mn is also reduced, so that generation of MnS, which becomes a source of starting points for pitting and markedly degrades wear resistance, is slight, making it possible to obtain a high-tensile H-shape steel excellent in pitting resistance and wear resistance.

Internal oxide layer formation is also closely related to seam flaws that occur at the inner surface of the high-tensile H-shape flange. These seam flaws act as starting points for pitting and markedly degrade wear resistance. Moreover, it was also discovered that the seam flaws occur owing to formation and folding-in of creases at the strain-concentration portion produced at the flange inner surface by slab edging. The inventors carried out a study regarding the addition of small amount of elemental Cr contributing to suppression of crease formation as a measure for preventing seam flaw occurrence, the formation of a grain boundary oxidation layer at the slab surface thereby, the effect thereof, and suppression of grain boundary oxidation layer occurrence.

By addition of Cr, formation of the grain boundary oxidation layer could be suppressed, corrosion and pitting depth enlargement could be suppressed, and by reducing Si amount, formation of grain boundary oxidation fayalite could be suppressed to suppress corrosion and pitting depth enlargement.

Moreover, in the present invention, addition of Ca, Mg and REM in addition to reduction of S content enables simultaneous reduction of solid solution S amount by formation of Sulfides.

Figure 3A:
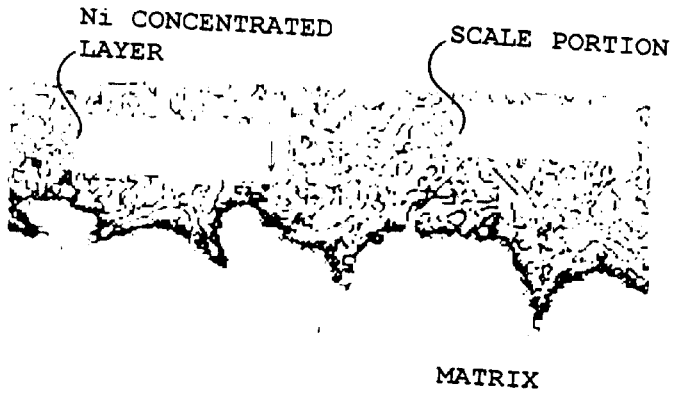
FIG. 3(*a*), FIG. 3(*b*) and FIG. 3(*c*) show the formed state of Ni, Cu and Mo concentrated layer according the present invention.
Figure 3B:
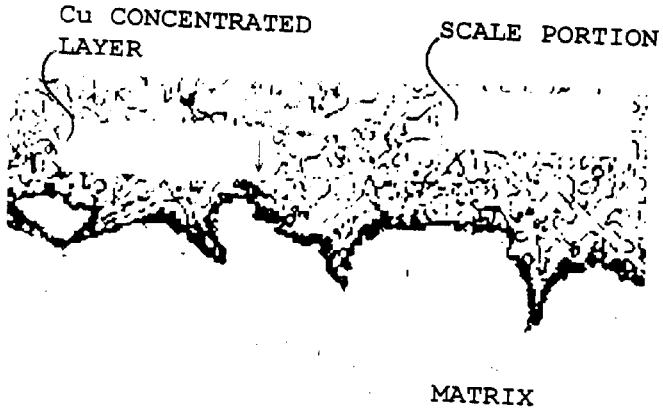
Figure 3C:
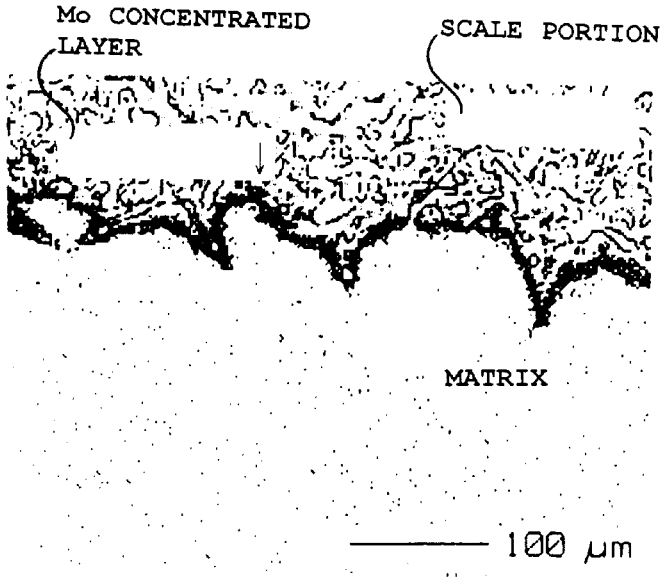

The inventors of the present invention also investigated the aforesaid wear resistance improvement from the viewpoint of the production process. They learned that in the case of a high-tensile H-shape steel added with Ni, Cu and Mo, a Ni, Cu and Mo concentrated layer is formed on the internal oxide layer and that the amount of this concentrated layer formed is strongly affected by the level of the slab heating temperature. In particular, they learned that when slab heating is conducted at a high temperature of 1100° C.~1300° C., preferably 1300° C., for 4.5 hours, the Ni, Cu and Mo concentrated layer comes to be formed to a thickness of 2 $\mu$m or greater, as shown in FIGS. 3(*a*), (*b*) and (*c*). On the other hand, they learned that in the case of conventional low-temperature heating at below 1100° C., the concentrated layer is either not formed, or if formed, becomes an extremely thin concentrated layer. As a result, corrosion and pitting depth are suppressed and wear resistance improvement can be achieved owing to the effect of a faster rate of stable rust formation.

Next, from the viewpoint of fatigue resistance strength, as was explained earlier, by reducing the amount of each of Si, Mn and Cr, which oxidize more readily than iron (FeO), generation of the internal oxide layer acting as a source of corrosion starting points can be markedly suppressed to prevent fatigue strength degradation by the softened layer/grain boundary oxidation layer that accompanies generation of the internal oxide layer. It should also be noted that the grain boundary oxidation layer produces strain concentration by the notch effect, which similarly is a cause of fatigue strength reduction. Fatigue strength can also be enhanced by reducing Si content and thus suppressing formation of grain boundary oxidation fayalite layer. In addition, the high-temperature slab heating at 1100° C.~1300° C., preferably 1300° C., for 4.5 hours forms a Ni, Cu and Mo concentrated layer of a thickness of 2 $\mu$m or greater on the oxidation-produced internal oxide layer, thereby increasing fatigue strength by the effect of suppressing softening of the surface layer internal oxide layer. Moreover, the fatigue strength has a substantially linear relationship with yield strength and tensile strength. Fatigue strength therefore increases with increasing yield strength and tensile strength.

Using various steel types, the inventors carried out tests with respect to steels added with Ni and Cu that exhibit pronounced grain boundary oxidation. A 590 MPa-class shape steel was added with small amounts of Mo and Cr as shown in Table 1. An ingot obtained by vacuum-melting and casting was cut in two, maintained at a temperature not higher than 1300° C. for about 4.5 hours in a reheating furnace, and the effect of the added elements on grain boundary oxidation behavior was investigated by texture observation, CMA and SEM analysis.

TABLE 1

Chemical analysis values of invention steels (wt %)

| | C | Si | Mn | Cu | Ni | Cr | Ti | Al | Mo | B | Ca | Mg | REM | Nb |
|---|---|---|---|---|---|---|---|---|---|---|---|---|---|---|
| Invention Steel | | | | | | | | | | | | | | |
| A | 0.02 | 0.03 | 1.94 | 0.41 | 0.34 | 0.11 | 0.013 | 0.003 | 0.14 | — | 0.0016 | 0.0031 | — | — |
| B | 0.17 | 0.02 | 0.45 | 0.86 | 0.71 | 0.21 | — | 0.002 | 0.38 | — | 0.0018 | — | 0.0019 | — |
| C | 0.05 | 0.02 | 0.81 | 1.10 | 1.80 | 0.18 | — | 0.003 | 0.53 | — | — | 0.0029 | — | 0.023 |
| D | 0.04 | 0.03 | 0.42 | 1.48 | 2.95 | 0.22 | 0.012 | 0.002 | 0.66 | 0.0006 | — | 0.0026 | — | 0.011 |
| Comparative Steel | | | | | | | | | | | | | | |
| E | 0.11 | 0.31 | 0.73 | — | — | — | — | 0.029 | — | — | — | — | — | — |
| F | 0.15 | 0.34 | 1.36 | — | — | — | — | 0.033 | — | — | — | — | — | 0.019 |
| G | 0.08 | 0.25 | 1.44 | 0.37 | 0.31 | 0.37 | 0.014 | 0.051 | 0.30 | — | — | — | — | 0.023 |

| | V | N | O | P | S | Ni/Cu |
|---|---|---|---|---|---|---|
| Invention Steel | | | | | | |
| A | — | 0.004 | 0.003 | 0.008 | 0.0042 | 0.8 |
| B | — | 0.004 | 0.003 | 0.008 | 0.0021 | 0.8 |
| C | — | 0.003 | 0.003 | 0.009 | 0.0018 | 2.2 |
| D | 0.03 | 0.003 | 0.002 | 0.007 | 0.0002 | 2.6 |
| Comparative Steel | | | | | | |
| E | — | 0.005 | 0.002 | 0.008 | 0.0048 | — |
| F | 0.03 | 0.005 | 0.002 | 0.009 | 0.0076 | — |
| G | 0.05 | 0.004 | 0.001 | 0.009 | 0.0043 | 0.8 |

Figure 4:
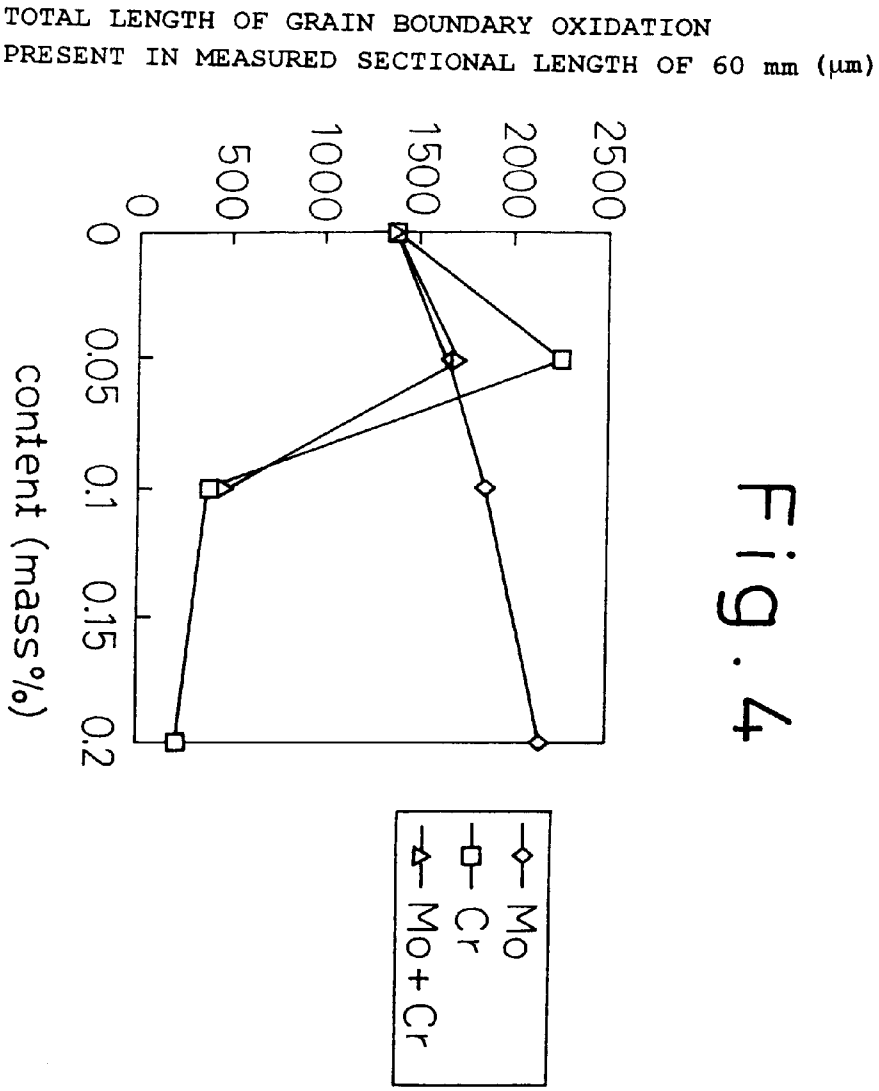
FIG. 4 is a graph illustrating the effect of Mo and Cr on grain boundary oxidation.
Figure 5A:
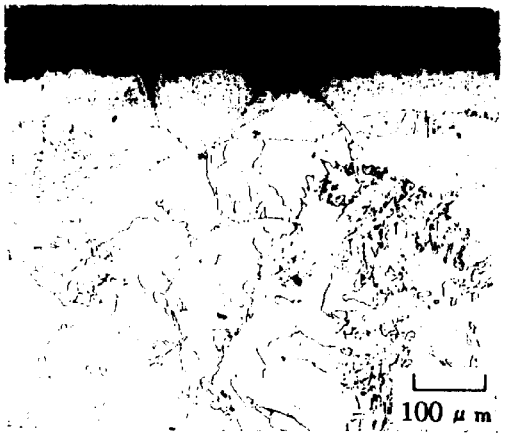
FIG. 5(*a*) is a sectional view of the texture of a conventional Cr-free steel.
Figure 5B:
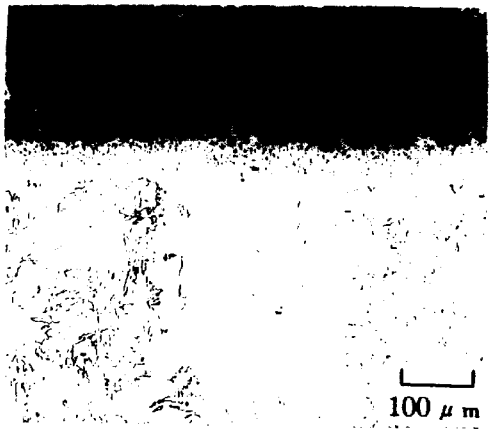

FIG. 4 shows how total boundary length of grain boundary oxidation varied with amount of alloying element addition when Mo, Cr and Mo+Cr were added in different amounts. (Sum of grain boundary oxidation portions present in sectional length of 60 mm at sample surface.) FIG. 5(*a*) is a photograph showing the sectional texture of a conventional Cr-free steel (with no added Cr) and FIG. 5(*b*) is a photograph showing the sectional texture of steel added with 0.20% of Cr. As can be seen from the sectional textures shown in these photographs, grain boundary oxidation is markedly suppressed by addition of 0.1~0.5% of Cr. On the other hand, as can be seen from FIG. 4, Mo tends to promote grain boundary oxidation.

The inventors further carried out CMA analysis on steels respectively added with 0.20% of Mo, 0.2% of Cr, and 0.1% of Mo+0.1% of Cr. It was found that while Mo was dispersed in the scale as oxide, Cr was dispersed in the internal oxide layer as Cr oxide. This tendency was very pronounced in the case of combined addition of Mo and Cr and it was learned that MO was present both in the scale and at the surface of the internal oxide layer but that Cr was present only in the internal oxide layer. The CMA-analyzed portion of the steel added with 0.20% of Cr, was examined for Cr and [O] composite concentration distribution. It was found that when the threshold level of [O] is lowered, there is observed a tendency for the region of Cr oxide distribution to spread toward the interior from the vicinity of the scale/internal oxide layer interface, thereby reducing the [O]/Cr ratio in the Cr oxide. In addition, SEM analysis was conducted with regard to the central portion of the internal oxide layer in the depth direction of samples identical with the foregoing steels. In the steel containing Mo at 0.20%, Si and O, thought to be fayalite ($2FeO.SiO_2$), were detected at the leading edge portion of the grain boundary oxidation layer and Mn was detected in addition to Si and O from the oxide grains of the internal oxide layer. On the other hand, in the steel added with Cr at 0.20%, Cr was detected in addition to Si and O in the oxide grains of the internal oxide layer.

Various factors for improving wear resistance were studied. The mechanism by which the aforesaid Cr addition suppresses formation of grain boundary oxidation layer is considered to derive from the following factors.

1) Oxygen, while diffusing from the surface to the interior along the path of the γ grain boundaries, does not form grain boundary oxidation layer because it immediately forms Cr oxide owing to the fact that Cr oxidizes more readily than Fe.
2) $Cr_2O_3$ and FeO readily form $FeO.Cr_2O_3$ spinel. This spinel is thought to require many cation holes. Cr and Fe ions diffusing through these cation holes and oxygen diffusing inward through the γ grain boundaries combine to form oxides, thereby inhibiting grain boundary diffusion of oxygen.
3) The formation of $FeO.Cr_2O_3$ spinel suppresses generation of low-melting-point fayalite so that grain boundary oxidation layer is not formed.

Thus, in the present invention, Si, the cause of the aforesaid fayalite generation, is reduced to the utmost so as to make the internal oxide layer extremely thin, and, in addition, Mn content is reduced to decrease formation of MnS, which markedly impairs wear resistance by becoming a source of pitting starting point. By this there is obtained a high-tensile H-shape steel excellent in pitting resistance and wear resistance.

The alloying component ranges and the production method of a structural steel excellent in wear resistance and fatigue resistance property according to the present invention will now be explained in detail.

Carbon (C) is added in the range of 0.02~0.20% for securing the yield strength and tensile strength required of a 40~70 kgf-class H-shape steel matrix.

Silicon (Si) is necessary ensuring matrix strength, preliminary deoxidation of the steel melt and the like, but when added at 0.1% or greater, forms MnSi.O and intensifies the tendency to form $2SiO_2.FeO$, which promotes increase of internal oxide layer and grain boundary oxidation. As a lower content is therefore better, its upper limit is set at 0.1%.

Manganese (Mn) is an element necessary for ensuring matrix strength. However, in light of the allowable concentration with regard to toughness and cracking property of the matrix and welds and the fact that MnS formed by Mn becomes a source of pitting starting points that markedly impair wear resistance, the upper limit of Mn must be set at 2.0%.

Chromium (Cr) is an important element in the present invention. Where the purpose is solely to reduce the internal oxide layer, a lower Cr content is better. On the other hand, the fact that the grain boundary oxidation layer can be suppressed by addition of a small amount of Cr was ascertained. When this effect is desired, Cr addition is essential. When formation of grain boundary oxidation layer is to be avoided by generating $FeO.Cr_2O_3$ spinel in order to suppress generation of low-melting-point fayalite, at least 0.1% or more of Cr is necessary. However, Cr added in excess of 0.5% becomes C.O to form the internal oxide layer and become a source of corrosion starting points. The upper limit of Cr is therefore set at 0.5%. The upper limit is set at 0.1% from the viewpoint of suppressing internal oxide layer formation in cases where the grain boundary oxidation suppressing effect is not needed.

Aluminum (Al) is a strong deoxidizing element. It is added up to an upper limit of 0.1% for deoxidation and steel cleaning, and for improving toughness by precipitating AlN to fix solid solution N. However, when Ca, Mg, REM and the like are added for positive utilization of their fine oxides, the amount of added Al should be made as small as possible because addition of a large amount obstructs the formation of fine oxides of Ca, Mg, REM and the like.

Titanium (Ti) precipitates TiN and, by reducing solid solution N, suppresses generation of island-like martensite and finely precipitated TiN contributes to γ phase refinement. These actions of Ti refine the texture and improve strength and toughness. When added at 0.1% or more, however, excess Ti precipitates TiC and the precipitation effect degrades the toughness of the matrix and weld heat affected zones. The upper limit of Ti is therefore defined as 0.1%.

In the present invention, addition of Ni, Cu and Mo is essential. All of these elements are high-strength elements that heighten matrix strength and toughness. They are also important elements for forming a Ni, Cu and Mo concentrated layer of 2 μm or greater on the internal oxide layer. The amount of addition of each varies with the other high-strength elements. In the case of Mn≦0.1% and Cr≦0.1%, it is necessary for ensuring strength to add 0.8~3.0% of Ni, 0.8~2.0% of Cu and 0.4~0.7% of Mo. In the case of Mn: 0.4~2.0% and Cr: 0.1~0.5%, it is necessary to add 0.3~3.0% of Ni, 0.3~1.5% of Cu and 0.4~0.7% of Mo.

Niobium (Nb) and vanadium (V) are added, at 0.005~0.10% of Nb and 0.01~0.20% of V, for the purpose of elevating hardenability and increasing strength. In the case of Nb exceeding 0.005% or of V exceeding 0.20%, however, the amount of precipitation of Nb carbonitride or v carbonitride increases and the effect as solid solution Nb or solid solution V saturates. Therefore, the upper limit of Nb is set at 0.10% and the upper limit of V at 0.20%. From the point of ensuring hardenability and matrix strength, the lower limit of Nb is set at 0.005% and the lower limit of V at 0.01%.

Boron (B) is an important element for the hardenability of the steel. It is added at 0.0003~0.0030%.

Nitrogen (N) forms nitrides that contribute to γ grain formation but excess solid solution N degrades toughness. N is therefore added to a content of 0.001~0.010%.

Magnesium (Mg), Ca and REM are added for the purpose of preventing generation of MnS, which degrades wear resistance by becoming a source of pitting starting points, namely, for the purpose of fixing sulfur by forming Mg, Ca and REM sulfides of higher high-temperature stability. Mg achieves low Mg content concentration by alloying, suppresses deoxidation reaction at the time of addition to the steel melt, improves safety assurance and Mg yield at the time of addition, generates fine MgO oxides, and, by finely dispersing these, contributes to improvement of steel strength and toughness. It is added at 0.0005~0.010% for these purposes. Ca and REM are added in the ranges of 0.0005~0.005% and 0.0005~0.010%, respectively, both for the purpose of preventing slab cracking.

The reason for defining the Ni/Cu concentration ratio as not less than 0.8 is to prevent surface cracking by high-temperature heating of a Cu-added steel. This cracking occurs when high-temperature heating to 1100° C. or higher causes Cu to concentrate on the internal oxide layer and molten Cu invades the γ grain boundaries to produce Cu fusion cracking. This cracking can be prevented by low-temperature heating at below 1100° C. or by Ni addition to make Ni/Cu≧0.8 and establish a high fusion point.

The reason for defining the thickness of the steel surface internal oxide layer as not greater than 2 μm is that, in actuality, the presence of a 20 μm-thick internal oxide layer forms a softened layer to approximately twenty-fold depth, i.e., to a depth of 200 μm. At an internal oxide layer thickness of 2 μm, the surface softened layer depth becomes 20 μm, which is the limit thickness for preventing fatigue and corrosion. The internal oxide layer is therefore defined as not greater than 2 μm.

The reason for defining the thickness of the Ni, Cu and Mo concentrated layer as not less than 2 μm is that from the results of EPMA measurement it was ascertained that, in a salt spray test, the wear resistance effect was low at a Ni, Cu and Mo concentrated layer thickness of 2 μm or less.

The reason for defining total amount of element concentration of Ni, Cu and Mo as not less than 7.0 wt % and, when Cr is added, as not less than 4.0 wt % is that a 1250° C. heating test showed the degree of Cu and Ni concentration on the internal oxide layer to be around 5~10 times and that of Mo to be around 2~5 times, so that the desired wear resistance and fatigue resistance property cannot be achieved at lower than around this concentration.

The production method of the present invention will now be explained.

An important process in the present invention is that high-temperature slab heating must be effected at a slab heating temperature of 1100~1300° C. This is for, in the aforesaid high-temperature slab heating, utilizing high-temperature heating oxidation to form on the internal oxide layer a Ni, Cu, Mo concentrated layer of a thickness of not less than 2 μm.

In the high-temperature heating oxidation, Ni, Cu and Mo concentrate to 2 μm or more on the internal oxide layer because the formation energy of the oxides of these metals is higher than that of iron oxide (FeO) and the metals therefore cannot form oxides and remain to concentrate on the internal oxide layer.

The result of 1250° C. heating is that the Ni, Cu and Mo concentrated layer forms to a thickness of around 30 μm. This is elongated by rolling to become thinner approximately in proportion to the elongation ratio. In other words, reduction of the thickness to 1/10 results in a thickness of about 3 μm.

Further, as explained earlier, the slab heated to a high temperature is subjected to hot rolling. In this hot rolling, it is necessary conduct the rolling at not higher than 950° C. to obtain a cumulative reduction of not less than 40%.

The reason for hot rolling at not higher than 950° C. to obtain a cumulative reduction of not less than 40% is that in order to achieve texture refinement by controlled rolling that controls the rolling temperature and rolling conditions it is necessary to apply not less than 40% reduction in the recrystallized/unrecrystallized temperature region of austenite.

EXAMPLE 1

For trial production of H-shape steels having the chemical component values of the invention steels and comparative steels shown in Table 2 were made in a converter, added with alloy metals, subjected to preliminary deoxidation to regulate the oxygen content of the steel melt, added with Ca and Mg alloy and REM, and continuously cast into 250~300 mm thick slab.

Figure 6:
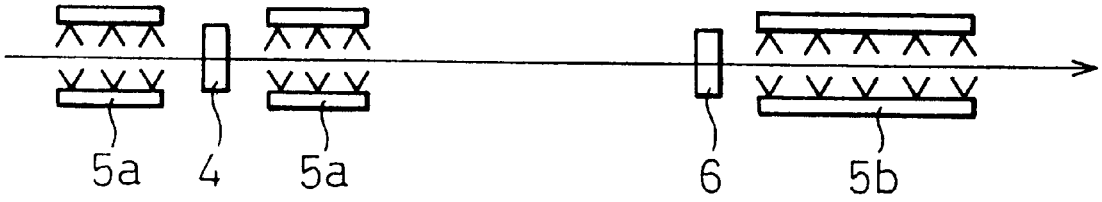
FIG. 6 is a diagram showing a universal rolling mill line used the present invention.

Cooling of the slab was controlled by selecting the amount of water of a secondary cooling zone under the mold and the slab extraction rate. The slab obtained in this manner was heated to a high temperature of 1280° C., roughed, and hot rolled into an H-shape using the universal rolling mill line shown in FIG. 6. For water cooling between rolling passes, water cooling devices 5*a* were installed before and after an intermediate universal rolling mill 4 and spray-cooling of the flange outside surfaces and reverse rolling were repeated. For accelerated water cooling after hot rolling, hot rolling was conducted with a finish universal rolling mill 6, followed by cooling with water. As required, depending on the steel type, after completion of hot rolling, the flange outer surface was spray-cooled by a cooling device 5*b* disposed at the rear surface thereof. The hot rolling and accelerated cooling conditions at this time are shown in Table 3.

The mechanical properties of the H-shape steels, obtained by the hot rolling are shown in Table 4. In particular, fatigue resistant property was as indicated by the relation between tensile strength and fatigue limit in FIG. 7. FIG. 8 shows the sectional shape of an H-shape steel and the location from which mechanical test pieces were taken. The aforesaid mechanical properties were determined using a test piece taken from an H-shape steel 1 having a flange 2 and a web 2, shown in FIG. 8, at the center portion of the thickness t2 of the flange 2 ($\frac{1}{2}t_2$) over ¼ the total flange width (B) (over ¼B). The properties were determined at these locations because the flange ¼F portion exhibits average mechanical properties of the H-shape steel and it was therefore considered that the mechanical test properties of the H-shape steel could be represented by this location.

Figure 7:
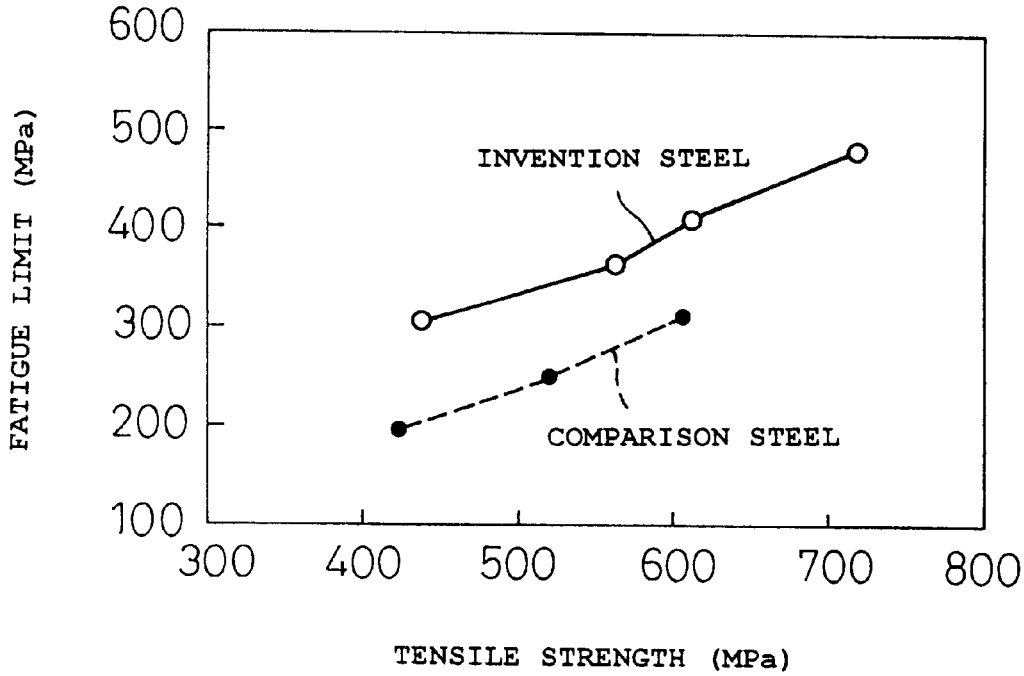
FIG. 7 is a graph showing relationship between tensile strength and fatigue limit.
Figure 8:
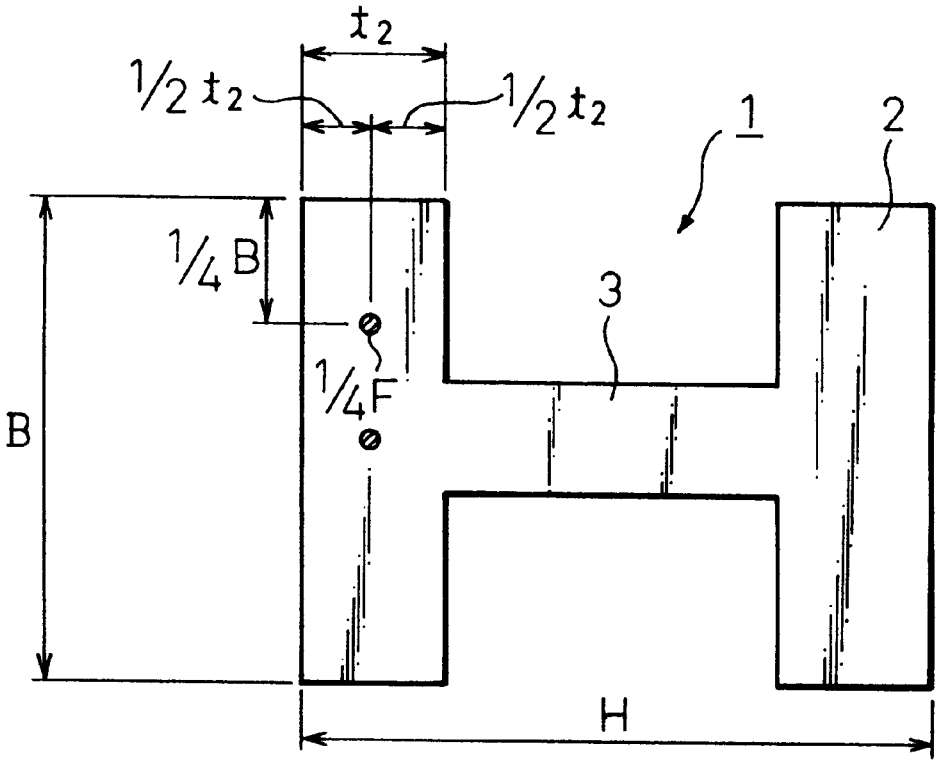
FIG. 8 is an illustration showing the sectional shape of an H-shape steel and the location from which mechanical test pieces were taken.

Thus when all conditions of both the steel composition and production method according to the present invention were satisfied, the H-shape steel shown in Table 4, and FIG. 7, could be produced as hot-rolled steels excellent in wear resistance and fatigue resistance property, and having high durability, like the invention steels A–D.

TABLE 2

Chemical analysis values of invention steels (wt %)

| | C | Si | Mn | Cu | Ni | Cr | Ti | Al | Mo | B | Ca | Mg | REM | Nb |
|---|---|---|---|---|---|---|---|---|---|---|---|---|---|---|
| Invention Steel | | | | | | | | | | | | | | |
| A | 0.03 | 0.03 | 0.04 | 1.01 | 0.84 | 0.04 | 0.012 | 0.002 | 0.68 | — | — | — | — | — |
| B | 0.06 | 0.06 | 0.03 | 1.97 | 1.89 | 0.02 | — | 0.003 | 0.58 | — | — | 0.0031 | — | 0.021 |
| C | 0.08 | 0.03 | 0.03 | 1.72 | 2.63 | 0.01 | — | 0.003 | 0.61 | — | 0.0021 | — | 0.0023 | — |
| D | 0.19 | 0.03 | 0.07 | 1.45 | 2.95 | 0.01 | 0.014 | 0.002 | 0.65 | 0.0009 | — | 0.0024 | — | 0.011 |
| Comparative Steel | | | | | | | | | | | | | | |
| E | 0.12 | 0.31 | 0.57 | 0.40 | 0.30 | 0.32 | — | 0.031 | — | — | — | — | — | — |
| F | 0.14 | 0.32 | 1.22 | 0.38 | 0.31 | 0.31 | — | 0.032 | — | — | — | — | — | 0.014 |
| G | 0.08 | 0.28 | 1.45 | 0.37 | 0.33 | 0.35 | 0.014 | 0.045 | 0.30 | — | — | — | — | 0.023 |

| | V | N | O | P | S | Ni/Cu |
|---|---|---|---|---|---|---|
| Invention Steel | | | | | | |
| A | — | 0.004 | 0.003 | 0.007 | 0.0015 | 0.83 |
| B | — | 0.002 | 0.002 | 0.009 | 0.0023 | 0.96 |
| C | — | 0.003 | 0.003 | 0.009 | 0.0025 | 1.53 |
| D | 0.03 | 0.004 | 0.002 | 0.008 | 0.0007 | 2.03 |
| Comparative Steel | | | | | | |
| E | — | 0.005 | 0.002 | 0.008 | 0.0061 | 0.75 |
| F | — | 0.004 | 0.002 | 0.007 | 0.0080 | 0.82 |
| G | 0.05 | 0.004 | 0.001 | 0.009 | 0.0032 | 0.89 |

TABLE 3

Dimensions and hot rolling conditions of H-shape steels

| | H-shape steel dimensions | Hot rolling finishing temperature (° C.) | Cumulative reduction at and below 950° C. (%) | Cooling rate after hot rolling (° C./s) |
|---|---|---|---|---|
| Invention Steel | | | | |
| A | 900x300x18x34 | 905 | 43 | Air cooling |
| B | 900x300x18x34 | 900 | 44 | 4 |
| C | 900x300x18x34 | 870 | 49 | 5 |
| D | 900x300x18x34 | 855 | 51 | 5 |
| Comparative steel | | | | |
| E | 900x300x18x34 | 935 | 35 | Air cooling |
| F | 900x300x18x34 | 905 | 43 | Air cooling |
| G | 900x300x18x34 | 905 | 42 | 5 |

in a converter, added with alloy metals, subjected to preliminary deoxidation to regulate the oxygen content of the steel melt, added with Ca and Mg alloy metals and REM, and continuously cast into 250~300 mm thick slab.

Cooling of the slab was controlled by selecting the amount of water of a secondary cooling zone under the mold and the slab extraction rate. The slab obtained in this manner was heated to a high temperature of 1280° C., roughed, and hot rolled into an H-shape steel using the universal rolling mill line shown in FIG. 6. The hot rolling and accelerated cooling conditions at this time are shown in Table 6.

The mechanical properties of the H-shape steels obtained by the hot rolling are shown in Table 7.

The fatigue property is shown in FIG. 7. FIG. 8 shows the sectional shape of an H-shape and the location from which mechanical test pieces were taken. The aforesaid mechanical properties were determined using a test piece taken from an H-shape steel 1 having a flange 2 and a web 2, shown in FIG. 8, at the center portion of the thickness t2 of the flange 2 ($\frac{1}{2}t_2$) over ¼ the total flange width (B) (over ¼B). The properties were determined at these locations because the flange ¼F portion exhibits average mechanical properties of the H-shape steel and it was therefore considered that the mechanical test properties of the H-shape steel could be represented by this location.

TABLE 4

Mechanical test properties, wear resistance and surface state of invention steels

| | YS (MPa) | TS (MPa) | E (%) | vE0 (J) | Fatigue limit (MPa) | Thickness reduction per side (mm) | Internal oxide layer thickness (μm) | Ni + Cu + Mo surface concentration (%) | Surface thickness of Ni + Cu + Mo ≧ 7 wt % (μm) |
|---|---|---|---|---|---|---|---|---|---|
| Invention steel | | | | | | | | | |
| A | 285 | 438 | 42 | 299 | 307 | 0.10 | 1.6 | 12 | 6.1 |
| B | 344 | 562 | 38 | 287 | 365 | 0.06 | 1.9 | 20 | 8.4 |
| C | 452 | 613 | 35 | 292 | 411 | 0.04 | 1.4 | 24 | 9.3 |
| D | 572 | 719 | 33 | 196 | 481 | 0.05 | 1.2 | 21 | 8.9 |
| Comparative steel | | | | | | | | | |
| E | 241 | 423 | 33 | 186 | 195 | 0.21 | 21.4 | 3 | 1.1 |
| F | 341 | 521 | 32 | 210 | 250 | 0.15 | 18.2 | 3 | 1.3 |
| G | 449 | 608 | 30 | 97 | 312 | 0.12 | 18.9 | 4 | 1.9 |

*Determined in conformity with atmosphere-exposure test method prescribed by JIS Z 0304. Test conducted at seashore region in Kimitsu City, Chiba Prefecture, Japan. Five-year exposure test was conducted with test piece tilted southward 45° from horizontal at 1 m above ground.

EXAMPLE 2

For trial production of H-shape steels, H-shape steels having the chemical component values of the invention steels and comparative steels shown in Table 5 were made

TABLE 5

Chemical analysis values of invention steels (wt %)

| | C | Si | Mn | Cu | Ni | Cr | Ti | Al | Mo | B | Ca | Mg | REM | Nb |
|---|---|---|---|---|---|---|---|---|---|---|---|---|---|---|
| Invention Steel | | | | | | | | | | | | | | |
| A | 0.02 | 0.03 | 1.94 | 0.41 | 0.34 | 0.11 | 0.013 | 0.003 | 0.14 | — | 0.0016 | 0.0031 | — | — |
| B | 0.17 | 0.02 | 0.45 | 0.86 | 0.71 | 0.21 | — | 0.002 | 0.38 | — | 0.0018 | — | 0.0019 | — |
| C | 0.05 | 0.02 | 0.81 | 1.10 | 1.80 | 0.18 | — | 0.003 | 0.53 | — | — | 0.0029 | — | 0.023 |
| D | 0.04 | 0.03 | 0.42 | 1.48 | 2.95 | 0.22 | 0.012 | 0.002 | 0.66 | 0.0006 | — | 0.0026 | — | 0.011 |
| Comparative Steel | | | | | | | | | | | | | | |
| E | 0.11 | 0.31 | 0.73 | — | — | — | — | 0.029 | — | — | — | — | — | — |

TABLE 5-continued

| Chemical analysis values of invention steels (wt %) | | | | | | | | | | | | | | |
|---|---|---|---|---|---|---|---|---|---|---|---|---|---|---|
| F | 0.15 | 0.34 | 1.36 | — | — | — | — | 0.033 | — | — | — | — | — | 0.019 |
| G | 0.08 | 0.25 | 1.44 | 0.37 | 0.31 | 0.37 | 0.014 | 0.051 | 0.30 | — | — | — | — | 0.023 |

| | V | N | O | P | S | Ni/Cu |
|---|---|---|---|---|---|---|
| Invention Steel | | | | | | |
| A | — | 0.004 | 0.003 | 0.008 | 0.0042 | 0.8 |
| B | — | 0.004 | 0.003 | 0.008 | 0.0021 | 0.8 |
| C | — | 0.003 | 0.003 | 0.009 | 0.0018 | 2.2 |
| D | 0.03 | 0.003 | 0.002 | 0.007 | 0.0002 | 2.6 |
| Comparative Steel | | | | | | |
| E | — | 0.005 | 0.002 | 0.008 | 0.0048 | — |
| F | 0.03 | 0.005 | 0.002 | 0.009 | 0.0076 | — |
| G | 0.05 | 0.004 | 0.001 | 0.009 | 0.0043 | 0.8 |

TABLE 6

Dimensions and hot rolling conditions of H-shape steels

| | H-shape steel dimensions | Hot rolling finishing temperature (° C.) | Cumulative reduction at and below 950° C. (%) | Cooling rate after hot rolling (° C./s) |
|---|---|---|---|---|
| Invention Steel | | | | |
| A | 900x300x18x34 | 915 | 41 | Air cooling |
| B | 900x300x18x34 | 905 | 43 | Air cooling |
| C | 900x300x18x34 | 875 | 48 | 4 |
| D | 900x300x18x34 | 860 | 50 | 6 |
| Comparative steel | | | | |
| E | 900x300x18x34 | 935 | 36 | Air cooling |
| F | 900x300x18x34 | 910 | 41 | Air cooling |
| G | 900x300x18x34 | 905 | 43 | 5 |

The hot rolled shape steel that is the subject of the present invention can be applied not only to the H-shape steel of the foregoing embodiments but also of course to other shape steels with flanges, such as angles, channels, and angles of unequal sides and thicknesses.

Industrial Applicability

As explained in the foregoing, the present invention enables provision, at low cost and by a simple production method, of a structural steel excellent in wear resistance and fatigue resistance property for use as a member of a bridge, pylon or the like erected in a shore region where there is concern about steel corrosion and fatigue at weld joint owing to scattering of sea salt particles or in a region where snow-melting salt is used.

What is claimed is:

1. A structural steel excellent in wear resistance and fatigue resistance property containing, in percentage by weight, C: 0.02–0.20%, and further added with small amounts of Ni, Cu and Mo as essential elements, characterized in having a Ni/Cu concentration ratio of not less than 0.8, a steel surface internal oxide layer having a thickness of

TABLE 7

Mechanical test properties, wear resistance and surface state of invention steels

| | YS (MPa) | TS (MPa) | E (%) | vE0 (J) | Fatigue limit (MPa) | Thickness reduction per side (mm) | Internal oxide layer thickness (μm) | Ni + Cu + Mo surface concentration (%) | Surface thickness of Ni + Cu + Mo ≧ 4 mass % (μm) |
|---|---|---|---|---|---|---|---|---|---|
| Invention steel | | | | | | | | | |
| A | 298 | 452 | 39 | 289 | 271 | 0.11 | 1.9 | 5 | 2.2 |
| B | 353 | 551 | 36 | 287 | 328 | 0.08 | 1.6 | 9 | 5.2 |
| C | 466 | 624 | 34 | 265 | 400 | 0.06 | 1.8 | 16 | 7.1 |
| D | 582 | 726 | 33 | 269 | 459 | 0.06 | 1.5 | 23 | 9.4 |
| Comparative steel | | | | | | | | | |
| E | 239 | 421 | 34 | 212 | 212 | 0.31 | 28.8 | — | — |
| F | 338 | 521 | 33 | 215 | 263 | 0.28 | 30.1 | — | — |
| G | 447 | 599 | 31 | 84 | 304 | 0.14 | 15.3 | 4 | 1.8 |

*Determined in conformity with atmosphere-exposure test method prescribed by JIS Z 0304. Test conducted at seashore region in Kimitsu City, Chiba Prefecture, Japan. Five-year exposure test was conducted with test piece tilted southward 45° from horizontal at 1 m above ground.

not greater than 2 μm, and a Ni, Cu and Mo concentrated layer of a thickness of not less than 2 μm on the internal oxide layer.

2. A structural steel excellent in wear resistance and fatigue resistance property containing, in percentage by weight, C: 0.02–0.20% and Cr: 0.1–0.5%, and further added with small amounts of Ni, Cu and Mo as essential elements, characterized in having a Ni/Cu concentration ratio of not less than 0.8, a steel surface internal oxide layer having a thickness of not greater than 2 μm, and a Ni, Cu and Mo concentrated layer of a thickness of not less than 2 μm on the internal oxide layer.

3. A structural steel excellent in wear resistance and fatigue resistance property characterized in comprising, in percentage by weight, C: 0.02~0.20%,
Mn: ≦0.1%,
Si: ≦0.1%,
Cr: ≦0.1%,
Al: ≦0.1%,
Ti: ≦0.1%,
Ni: 0.8~3.0%,
Cu: 0.8~2.0%,
Mo: 0.4~0.7%,
N: 0.001~0.01%,
P: ≦0.1%, and
S: ≦0.006%, the Ni/Cu concentration ratio being not less than 0.8 and the balance being Fe and unavoidable impurities, and having a steel surface internal oxide layer having a thickness of not greater than 2 μm, and a Ni, Cu and Mo concentrated layer of a thickness of not less than 2 μm on the internal oxide layer, the total amount of element concentration of Ni, Cu and Mo being not less than 7.0 wt %.

4. A structural steel excellent in wear resistance and fatigue resistance property characterized in comprising, in percentage by weight, C: 0.02~0.20%,
Mn: 0.4~2.0%,
Si: ≦0.1%,
Cr: 0.1~0.5%,
Al: 0.001~0.10%,
Ti: ≦0.1%,
Ni: 0.3~3.0%,
Cu: 0.3~1.5%,
Mo: 0.1~0.7%,
N: 0.001~0.010%,
P: ≦0.1%, and
S: ≦0.006%, the Ni/Cu concentration ratio being not less than 0.8 and the balance being Fe and unavoidable impurities, and having a Ni, Cu and Mo concentrated layer having a thickness of not less than 2 μm on a steel surface internal oxide layer having a thickness of not greater than 2 μm, the total amount of element concentration of Ni, Cu and Mo being not less than 4.0 wt %.

5. A structural steel excellent in wear resistance and fatigue resistance property set out in any of claim 1, characterized in further comprising in percentage by weight, at least one of Nb: 0.005~0.10%, V: 0.01~0.20% and B: 0.0003~0.0030%.

6. A structural steel excellent in wear resistance and fatigue resistance property set out in any of claim 1, characterized in further comprising, in percentage by weight, at least one of Ca: 0.0005~0.0050%, Mg: 0.0005~0.010% and REM: 0.0005~0.010%.

7. A structural steel excellent in wear resistance and fatigue resistance property set out in any of claim 1, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

8. A method of producing a structural steel excellent in wear resistance and fatigue resistance property characterized in starting hot rolling of a slab after reheating to a temperature range of 1100~1300° C., conducting hot rolling at not higher than 950° C. to obtain a cumulative reduction of not less than 40%, and completing hot rolling at not lower than 900° C., thereby obtaining as-hot-rolled steel having a surface internal oxide layer having a thickness of not greater than 2 μm, and a Ni, Cu and Mo concentrated layer of a thickness of not less than 2 μm on the internal oxide layer, the total amount of element concentration of Ni, Cu and Mo being not less than 7.0 wt %, the slab comprising, in percentage by weight, C: 0.02~0.20%,
Mn: ≦0.1%,
Si: ≦0.1%,
Cr: ≦0.1%,
Al: ≦0.1%,
Ti: ≦0.1%,
Ni: 0.8~3.0%,
Cu: 0.8~2.0%,
Mo: 0.4~0.7%,
N: 0.001~0.01%,
P: ≦0.1%, and
S: ≦0.006%, Ni/Cu concentration ratio being not less than 0.8 and the balance being Fe and unavoidable impurities.

9. A method of producing a structural steel excellent in wear resistance and fatigue resistance property characterized in starting rolling of a slab after reheating to a temperature range of 1100~1300° C., and conducting hot rolling at not higher than 950° C. to obtain a cumulative reduction of not less than 40%, thereby obtaining a Ni, Cu and Mo concentrated layer of a thickness of not less than 2 μm on a steel surface internal oxide layer having a thickness of not greater than 2 μm, the total amount of element concentration of Ni, Cu and Mo being not less than 4.0 wt %, the slab comprising, in percentage by weight, C: 0.02~0.20%,
Mn: 0.4~2.0%,
Si: ≦0.1%,
Cr: 0.1~0.5%,
Al: 0.001~0.10%,
Ti: ≦0.1%,
Ni: 0.3~3.0%,
Cu: 0.3~1.5%,
Mo: 0.1~0.7%,
N: 0.001~0.010%,
P: ≦0.1%, and
S: ≦0.006%, the Ni/Cu concentration ratio being not less than 0.8 and the balance being Fe and unavoidable impurities.

10. A method of producing a structural steel excellent in wear resistance and fatigue resistance property set out in claim 8, characterized in further comprising, in percentage by weight, at least one of Nb 0.005~0.10%, V: 0.01~0.20% and B: 0.0003~0.0030%.

11. A method of producing a structural steel excellent in wear resistance and fatigue resistance property set out in claim 8, characterized in further comprising, in percentage by weight, at least one of Ca: 0.0005~0.0050%, Mg: 0.0005~0.010% and REM: 0.0005~0.010%.

12. A method of producing a structural steel excellent in wear resistance and fatigue resistance property set out in claim 8, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

13. A structural steel excellent in wear resistance and fatigue resistance property set out in claim 2, characterized in further comprising, in percentage by weight, at least one of Nb: 0.005~0.10%, V: 0.01~0.20% and B: 0.0003~0.0030%.

14. A structural steel excellent in wear resistance and fatigue resistance property set out in claim 3, characterized in further comprising, in percentage by weight, at least one of Nb: 0.005~0.10%, V: 0.01~0.20% and B: 0.0003~0.0030%.

15. A structural steel excellent in wear resistance and fatigue resistance property set out in claim 4, characterized in further comprising, in percentage by weight, at least one of Nb: 0.005~0.10%, V: 0.01~ 0.20% and B: 0.0003~0.0030%.

16. A structural steel excellent in wear resistance and fatigue resistance property set out in claim 2, characterized in further comprising, in percentage by weight, at least one of Ca: 0.0005~0.0050%, Mg: 0.0005~0.010% and REM: 0.0005~0.010%.

17. A structural steel excellent in wear resistance and fatigue resistance property set out in claim 3, characterized in further comprising, in percentage by weight, at least one of Ca: 0.0005~0.0050%, Mg: 0.0005~0.010% and REM: 0.0005~0.010%.

18. A structural steel excellent in wear resistance and fatigue resistance property set out in claim 4, characterized in further comprising, in percentage by weight, at least one of Ca: 0.0005~0.0050%, Mg: 0.0005~0.010% and REM: 0.0005~0.010%.

19. A structural steel excellent in wear resistance and fatigue resistance property set out in claim 2, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

20. A structural steel excellent in wear resistance and fatigue resistance property set out in claim 3, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

21. A structural steel excellent in wear resistance and fatigue resistance property set out in claim 4, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

22. A method of producing a structural steel excellent in wear resistance and fatigue resistance property set out in claim 9, characterized in further comprising, in percentage by weight, at least one of Nb: 0.005~0.10%, V: 0.01~0.20% and B: 0.0003~0.0030%.

23. A method of producing a structural steel excellent in wear resistance and fatigue resistance property set out in claim 9, characterized in further comprising, in percentage by weight, at least one of Ca: 0.0005~0.0050%, Mg: 0.0005~0.010% and REM: 0.0005~0.010%.

24. A method of producing a structural steel excellent in wear resistance and fatigue resistance property set out in claim 9, characterized in further comprising, in percentage by weight, at least one of Nb: 0.005~0.10%, V: 0.01~0.20% and B: 0.0003~0.0030%, and at least one of Ca: 0.0005~0.0050%, Mg: 0.0005~0.010% and REM: 0.0005~0.010%.

* * * * *